US005551154A

United States Patent [19]

Tanahashi et al.

[11] Patent Number: 5,551,154

[45] **Date of Patent: * Sep. 3, 1996**

[54] RECIPROCATORY DRY SHAVER

[75] Inventors: Masao Tanahashi; Takeshi Shiba; Toshio Ikuta, all of Hikone, Japan

[73] Assignee: Matsushita Electric Works, Ltd., Osaka, Japan

[ * ] Notice: The term of this patent shall not extend beyond the expiration date of Pat. No. 5,398,412.

[21] Appl. No.: 428,624

[22] Filed: Apr. 25, 1995

Related U.S. Application Data

[62] Division of Ser. No. 377,361, Jan. 24, 1995, which is a division of Ser. No. 47,501, Apr. 19, 1993, Pat. No. 5,398, 412.

[30] Foreign Application Priority Data

| | | | |
|---|---|---|---|
| Apr. 23, 1992 | [JP] | Japan | 4-103330 |
| Dec. 22, 1992 | [JP] | Japan | 4-342204 |

[51] Int. Cl.[6] ..... B26B 19/04; B26B 19/06

[52] U.S. Cl. ..... 30/43.92; 30/43.9

[58] Field of Search ..... 30/34.1, 43.9, 30/43.91, 43.92

[56] References Cited

U.S. PATENT DOCUMENTS

| | | | |
|---|---|---|---|
| 2,181,038 | 11/1939 | Wimberger | 30/43 |
| 3,037,280 | 5/1962 | Paoli | 30/43 |
| 3,176,392 | 4/1965 | Gwinn | 30/43.9 |
| 3,589,005 | 6/1971 | Fischer et al. | 30/34.1 |
| 3,648,367 | 3/1972 | Tolmie | 30/43.6 |
| 3,967,372 | 7/1976 | Beck et al. | 30/34.1 |
| 4,292,737 | 10/1981 | Packham | 30/43.92 |
| 4,578,861 | 4/1986 | Schweingrüber et al. | 30/43.92 |
| 4,886,843 | 12/1989 | Walton | 522/174 |
| 4,941,259 | 7/1990 | Wolf | 30/34.1 |
| 5,159,755 | 11/1992 | Jestadt et al. | 30/43.92 |
| 5,185,926 | 2/1993 | Locke | 30/43.92 |
| 5,189,792 | 3/1993 | Otsuka et al. | 30/43.92 |
| 5,231,761 | 8/1993 | Heinke | 30/43.92 |
| 5,398,412 | 3/1995 | Tanahashi et al. | 30/43.92 |

FOREIGN PATENT DOCUMENTS

| | | |
|---|---|---|
| 18-18267 | 7/1943 | Japan . |
| 45-16992 | 6/1970 | Japan . |
| 48-4720 | 2/1973 | Japan . |
| 49-17507 | 5/1974 | Japan . |
| 55-86490 | 6/1980 | Japan . |
| 56-35188 | 8/1981 | Japan . |
| 57-35032 | 7/1982 | Japan . |
| 59-141983 | 8/1984 | Japan . |
| 4-220282 | 8/1992 | Japan . |
| 4-231991 | 8/1992 | Japan . |
| WO9312916 | 7/1993 | WIPO . |

*Primary Examiner*—Scott A. Smith
*Assistant Examiner*—Jay A. Stelacone
*Attorney, Agent, or Firm*—Watson Cole Stevens Davis P.L.L.C.

[57] ABSTRACT

A reciprocatory dry shaver has a head from mounting three elongated cutter heads, one center cutter head and two outer cutter heads extending in parallel with each other. Each cutter head comprises a holder carrying a stationary cutter and a movable cutter driven to reciprocate in shearing engagement with the stationary cutter. The head frame is mounted on a shaver housing from which a reciprocating element projects to drive the movable cutter of each cutter head. The center and outer cutter heads are floatingly supported at individual longitudinal ends by associated center and outer spring members so that each cutter head is vertically movable relative to the head frame. The center spring members are formed in one of the head frame and the associated holder while the outer spring members are formed in the other of the head frame and the associated holders. Thus, the spring members for floatingly supporting the center and outer cutter heads can be effectively distributed to the head frame and the associated holders to enable compact arrangement for a system of floating supporting the three parallel cutter heads within a limited space.

9 Claims, 12 Drawing Sheets

RECIPROCATORY DRY SHAVER

This is a divisional of application Ser. No. 08/377,361, filed Jan. 24, 1995; which in turn is a division of application Ser. No. 08/047,501, filed Apr. 19, 1993, now U.S. Pat. No. 5,398,412.

BACKGROUND OF THE INVENTION

1. Field of the Invention

The present invention is directed to a reciprocatory dry shaver, and more particularly, to a reciprocatory dry shaver having three cutter heads extending in closely adjacent and parallel relation to each other.

2. Description of the Prior Art

Reciprocatory dry shavers having a plurality of floating cutter heads are known in the art, for example, as disclosed in U.S. Pat. No. 5,189,792. In the prior art shaver, a head frame is provided on a shaver housing to mount two cutter heads of elongated configuration. The two cutter heads are floatingly supported at longitudinal ends thereof to associated end walls of the head frame by means of spring members. The spring members are formed within the end walls so as not to add extra width and length dimensions to the head frame even with the incorporation of the support members in the head frame. Nevertheless, when the head frame is required to mount additional floating cutter head for more sophisticated shaving performance in cooperation with the two other cutter heads, additional spring members are difficult to accommodate within a limited space in the end walls of the head frame and could be accommodated within the end wail only at the expense of a considerable increase in the size of the head frame, which fails to give a compact design to the head frame.

SUMMARY OF THE INVENTION

The above problem and insufficiency have been eliminated in the present invention which provides a reciprocatory dry shaver with an improved floating structure. The dry shaver in accordance with the present invention comprises a shaver housing mounting a head frame and a reciprocating element. The head frame carries three elongated cutter heads each having a longitudinal axis and having opposed longitudinal ends spaced along the longitudinal axis. The three cutter heads comprise a center cutter head and two outer cutter heads arranged on opposite sides of the center cutter head in parallel therewith. Each of the center and outer cutter heads comprises a holder carrying a stationary cutter and a movable cutter which is driven by the reciprocating element to reciprocate along the longitudinal axis in close engagement with the stationary cutter to effect hair shaving therebetween. The center and outer cutter heads are floatingly supported at the individual longitudinal ends respectively by associated center and outer spring members so that each cutter head is vertically movable relative to the head frame. The center spring members are formed in the head frame while the outer spring members are formed in the holders of the associated outer cutter heads. Thus, the center and outer spring members for floatingly supporting the three cutter heads can be effectively distributed to the head frame and the associated holders, which is advantageous for accommodating all the necessary spring members within a compact structure.

Accordingly, it is a primary object of the present invention to provide a reciprocatory dry shaver in which three floating cutter heads can be well accommodated together with the associated spring members within a limited space for compact design.

The center cutter head is provided for rough shaving while the outer cutter heads are provided for smooth or finishing shaving so that the center cutter head is cooperative with at least one of the outer cutter heads to achieve an effective shaving operation in which rough and smooth shavings can be done successively or almost concurrently. For this purpose, the outer cutter head has the stationary cutter which is in the form of an arcuately curved shearing foil or net with a number of perforations and has the movable cutter composed of a plurality of arcuately contoured blades in engagement with the shearing foil for smooth shaving. On the other hand, the center cutter has a stationary cutter which is configured to have a slotted flat top for contact with the skin of the user, and has the movable cutter composed of a plurality of inner blades in engagement with the lower surface of the flat top for rough shaving. Alternately, the center cutter head may comprises a stationary blade with a toothed edge and a movable blade with a like toothed edge. The stationary and movable blades project generally vertically between the two outer cutter heads for rough hair shaving or trimming.

In the absence of external force, the center cutter head for rough shaving is held in position with its upper end disposed at substantially the same height as the upper ends of the outer cutter heads for smooth shaving so that the three cutter heads can be brought into contact with the skin of the user either simultaneously or selectively. In a preferred embodiment, the center cutter head for rough shaving is biased upwardly by a biasing force from the associated center spring members which is less than that of of the biasing of the outer cutter heads such that the center cutter head can be depressed easier than the outer cutter head. With this arrangement, once the rough shaving is done by the cutter head, the center cutter head can be easily set aside to render smooth shaving primarily by the outer cutter heads, which is therefore another object of the present invention.

In order to differentiate the biasing forces for the center and outer cutter heads, first springs are provided at the connection of the reciprocating element and the movable cutters of the outer cutter heads so as to give additional upward bias to the outer cutter heads. Thus, the outer cutter heads can receive upward bias from the first spring and the outer spring members to thereby give greater resistance than the center cutter head when depressed downwardly.

In a preferred embodiment, one of the outer cutter heads is coupled to the center cutter head by an interlock engagement which allows the center cutter head to move vertically downwardly together with the cutter head when the cutter head moves vertically downwardly beyond a predetermined distance. In this manner, the center cutter head for rough shaving is capable of retracting together with the adjacent outer cutter head being depressed so as not to interfere with smooth shaving by the outer cutter head for assuring an effective shaving operation.

It is therefore a further object of the present invention to provide a reciprocatory dry shaver in which the center head can follow the depressing movement of the adjacent outer cutter head in such a manner as not to hinder the shaving by the outer cutter head.

The center spring member for the center cutter head is formed within an associated end wall of the head frame and comprises a pair of vertically spaced resilient beams extending in substantially a parallel relation to each other and a coupler which joins the free ends of the resilient beams so that the spring member is vertically movable relative to the end wall of the head frame by resiliently deforming the resilient beams. The coupler is connected to the holder of the center cutter head at a longitudinal end thereof. The resilient beams extend from one lateral side of the end wall of the head frame toward the other lateral side in such a manner that the spring member is offset on the one lateral side of the end wall. Thus, the resilient beam can be designed to extend over a long distance within a limited width of the end wall to give sufficient resiliency for floatingly supporting the center cutter head, which is therefore a still further object of the present invention.

In order to facilitate the assembly of at least one of the cutter heads to the head frame, a unique fastener structure is utilized for coupling of the cutter head to the head frame. The fastener structure comprises a pair of vertically spaced first and second bosses projecting from one of either the holder of the cutter head or the head frame and into intimate engagement with a pair of first and second holes correspondingly formed in the other of the holder the head frame. The second boss is made greater than the first boss so as to avoid the wrong engagement of the second boss into the first hole during the assembly of moving the holder into the head frame vertically along the direction in which the first and second bosses are aligned.

These and still other objects and advantages will become more apparent from the following detailed description of the preferred embodiment of the present invention when taken in conjunction with the attached drawings.

DETAILED DESCRIPTION OF THE EMBODIMENTS

First Embodiment <FIGS. 1 to 12>

Figure 1:
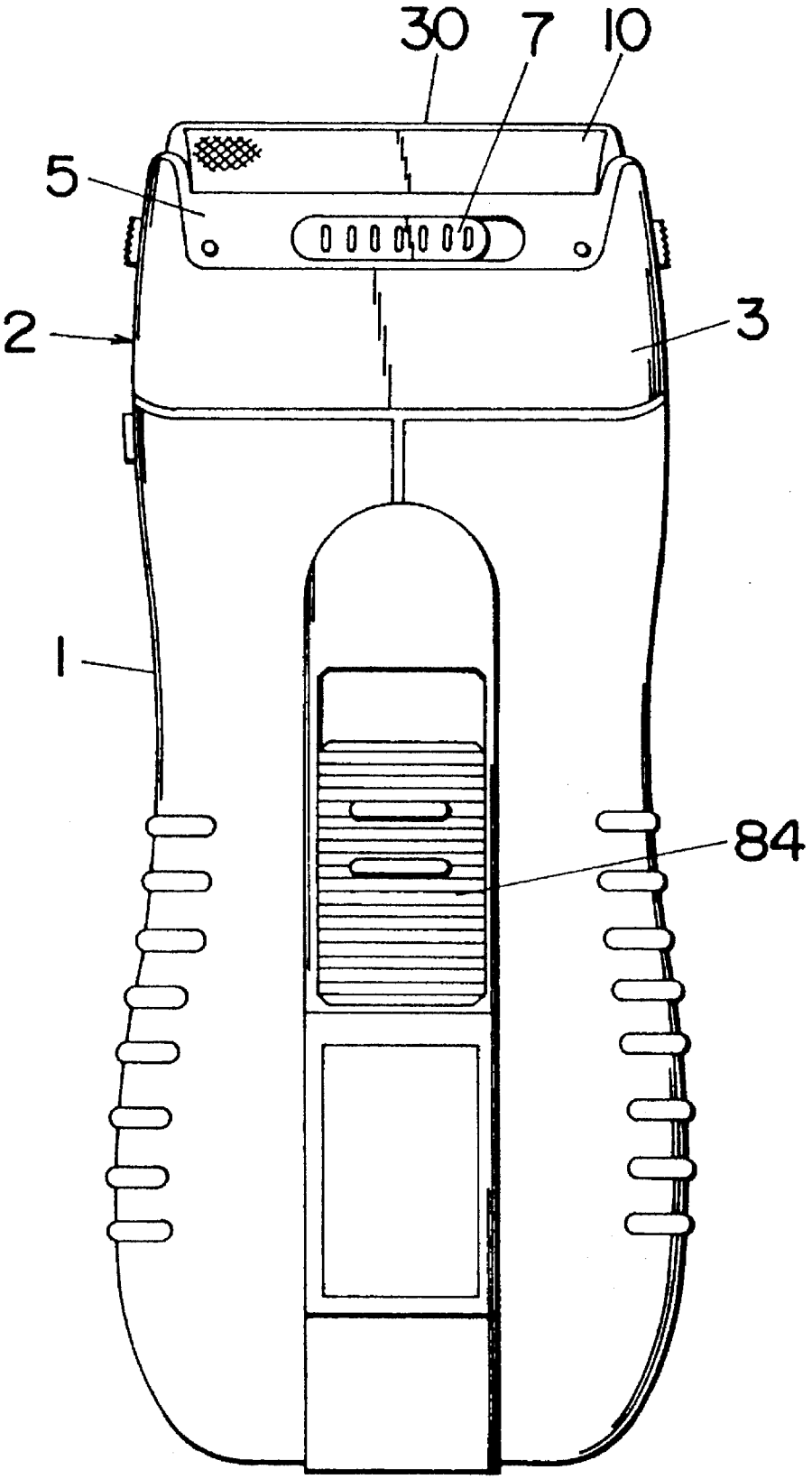
FIG. 1 is a perspective view of a reciprocatory dry shaver in accordance with a first embodiment of the present invention.
Figure 2:
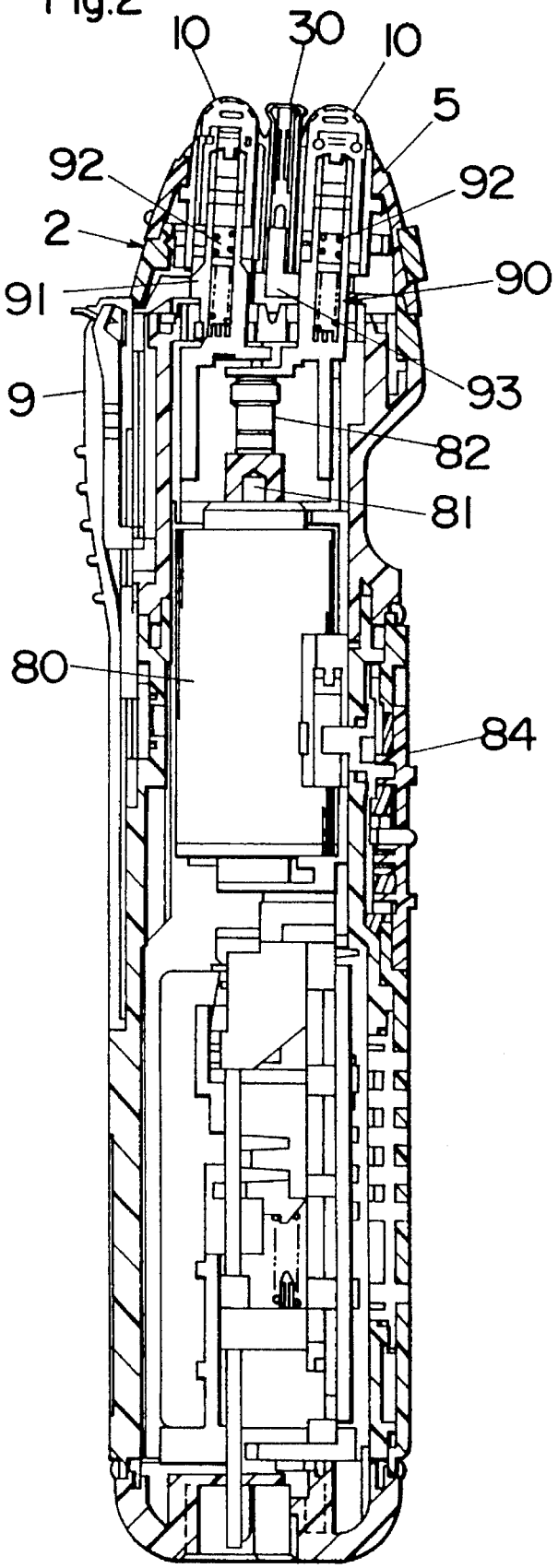
FIG. 2 is a vertical side section of the shaver of FIG. 1.
Figure 3:
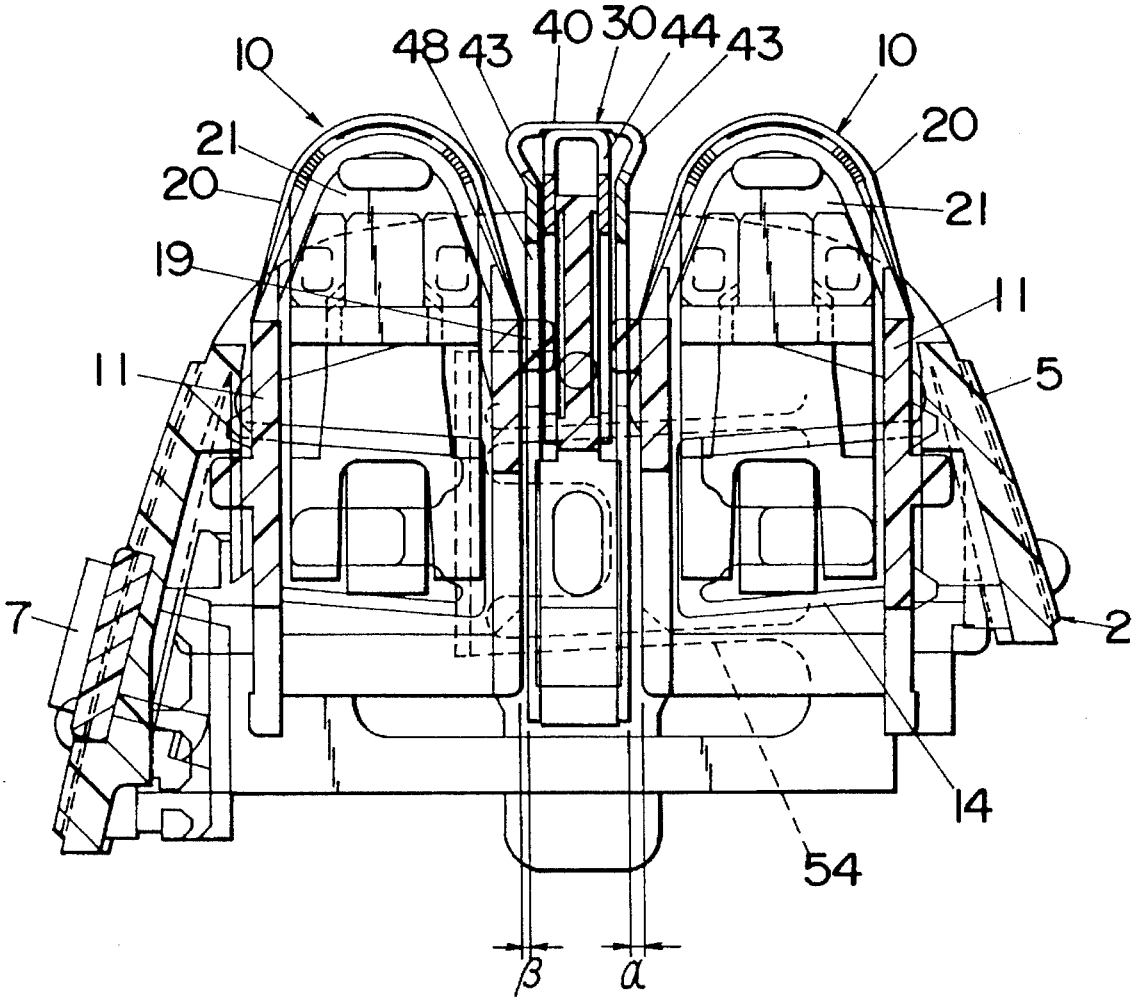
FIG. 3 is an enlarged vertical side section of a shaver head of the shaver of FIG. 1.
Figure 4:
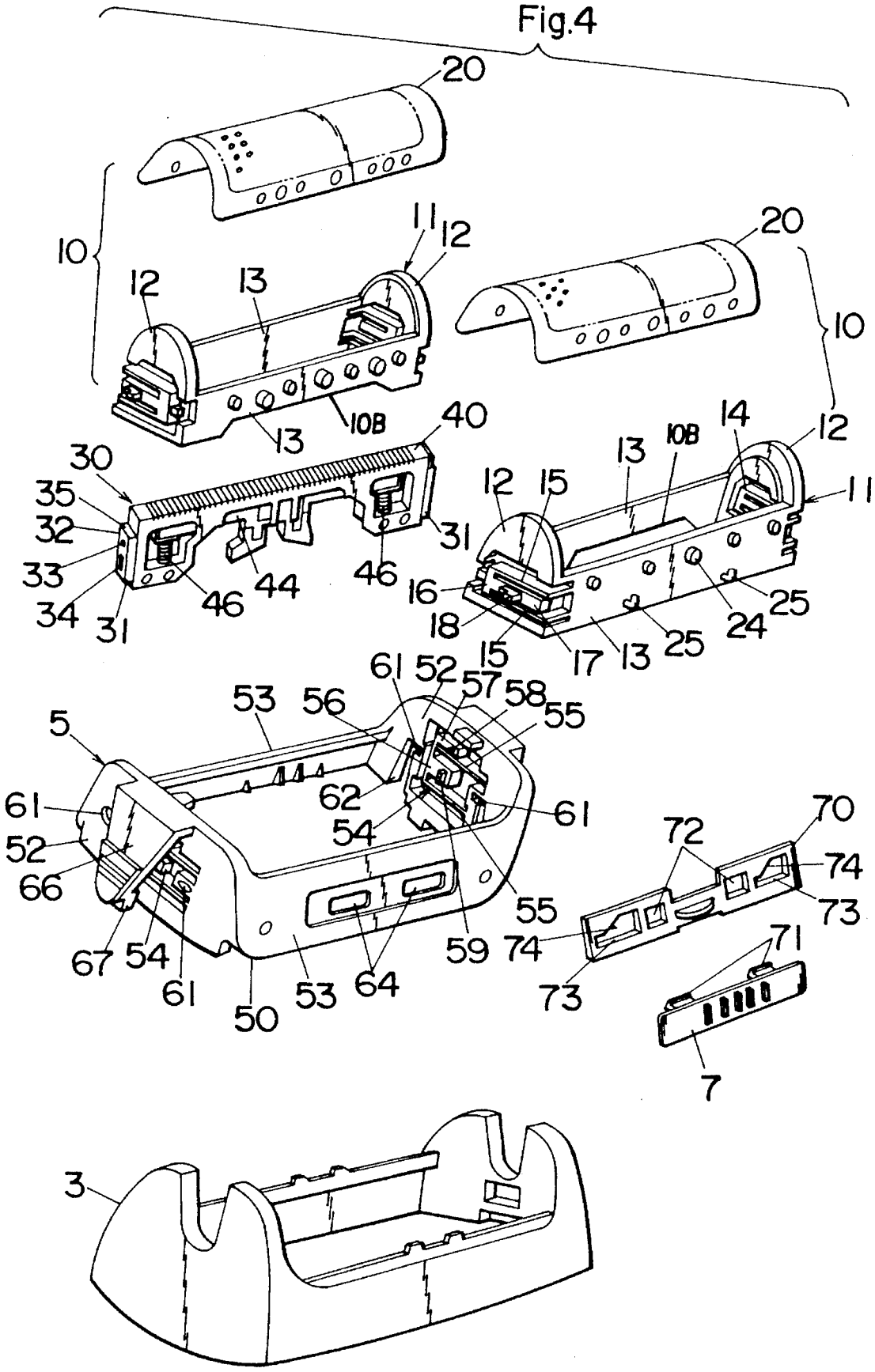
FIG. 4 is an exploded perspective view of the shaver head.
Figure 5:
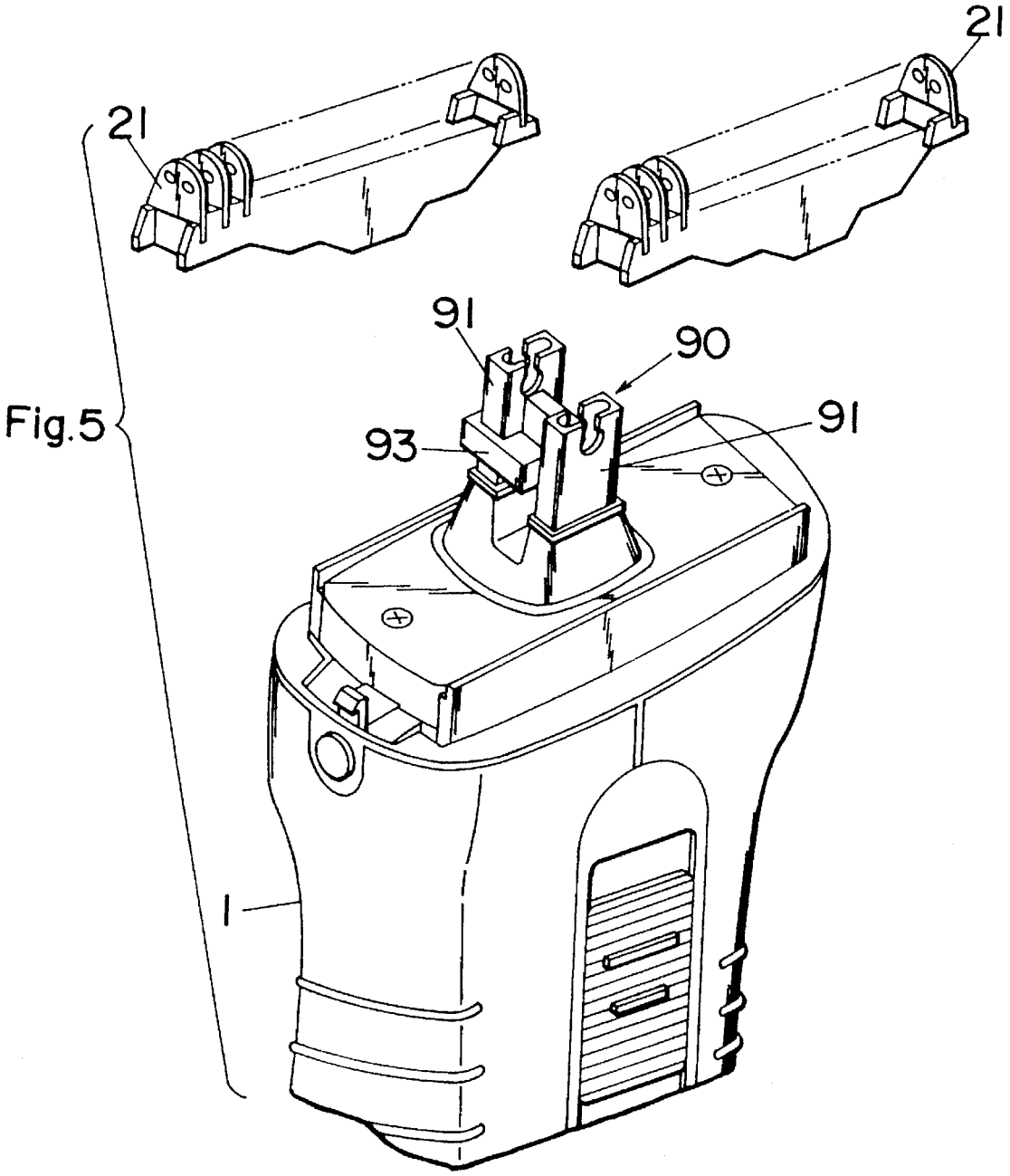
FIG. 5 is an exploded perspective view of the shaver with the shaver head removed.

Referring now to FIGS. 1 to 6, there is shown a reciprocatory electric shaver in accordance with a first embodiment of the present invention. The shaver comprises a shaver housing 1 with a shaver head 2 mounting three elongated cutter heads composed of two outer cutter heads 10 and a single center cutter head 30 arranged in side-by-side relation. The shaver head 2 comprises a support frame 3 on the top of the shaver housing 1 and a head frame 5 detachably supported within the support frame 3. It is through this head frame 5 that the cutter heads 10 and 30 are mounted to the support frame 3. Incorporated within the housing 1 is an electric motor 80 with an output rotor shaft 81 which is connected through rotary-to-reciprocation conversion element 82 to reciprocate a joint assembly 90 projecting on the housing 10, as best shown in FIG. 5. As will be explained later, the joint assembly 90 is coupled to movable parts of the outer and center cutter heads 10 and 30 to effect intended shavings thereat, respectively. The head frame 5 is assembled into a unitary structure including the three cutter heads 10 and 90 and is detachable to the support frame 3 as one replacement part.

The outer cutter heads 10 are provided for smooth or finish shaving and each comprises perforated shearing foil 20 and a movable cutter block 21 with a number of blades driven by the joint assembly 90 to reciprocate in hair shearing engagement with the foil 20. The shearing foil 20 is arcuately curved into a generally U-shaped configuration with an apex extending longitudinally of the cutter head 10 and is carried on rectangular holder 11 which is molded from a plastic material to comprise opposed end plates 12 bridged by opposed side plates 13. As shown in FIG. 4 the opposed side plates 13 each have along their lower edge an elongated recess 10B which is provided to facilitate removal or discharge of sheared hairs for easy cleaning.

Figure 6:
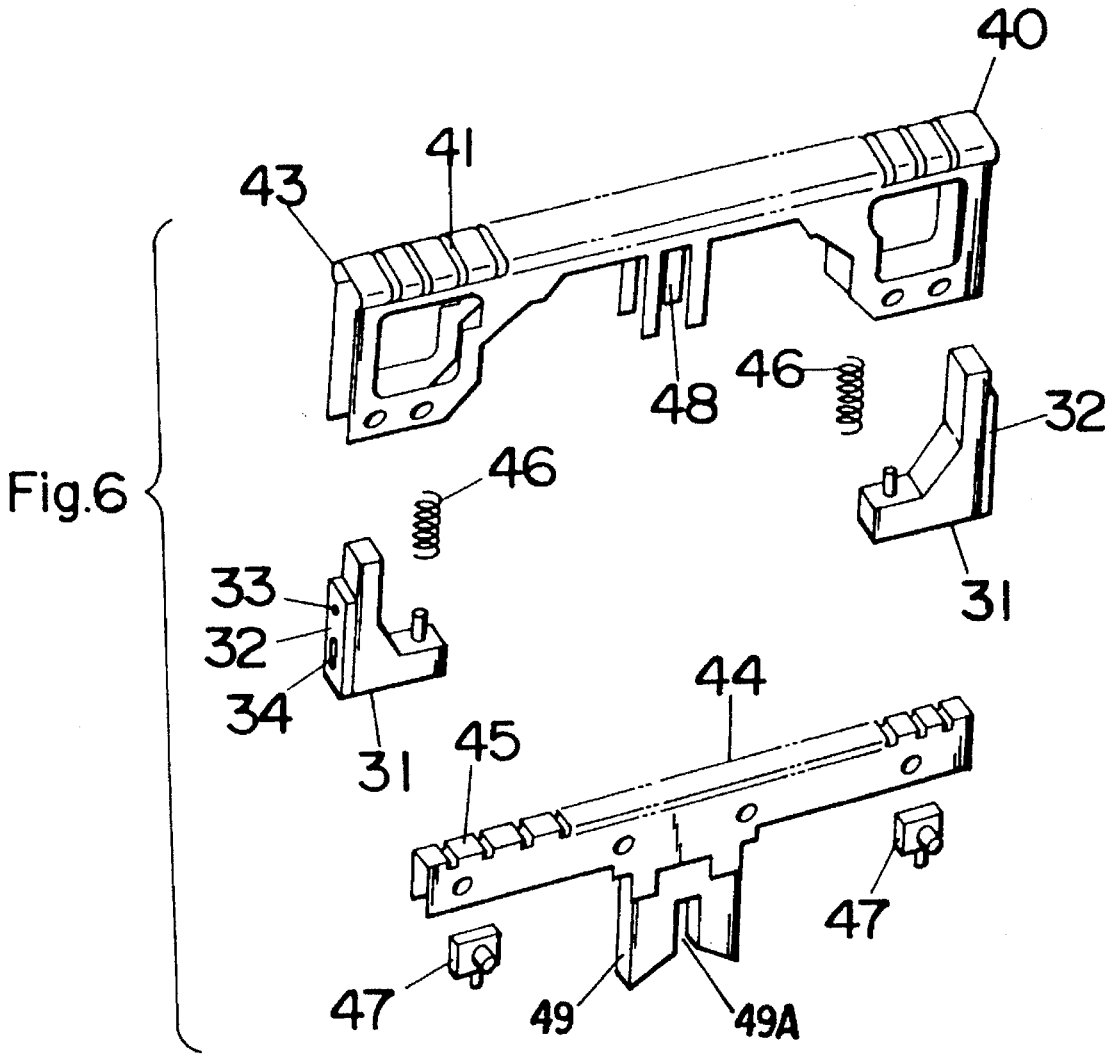
FIG. 6 is an exploded perspective view of a center cutter head of the shaver.
Figure 7:
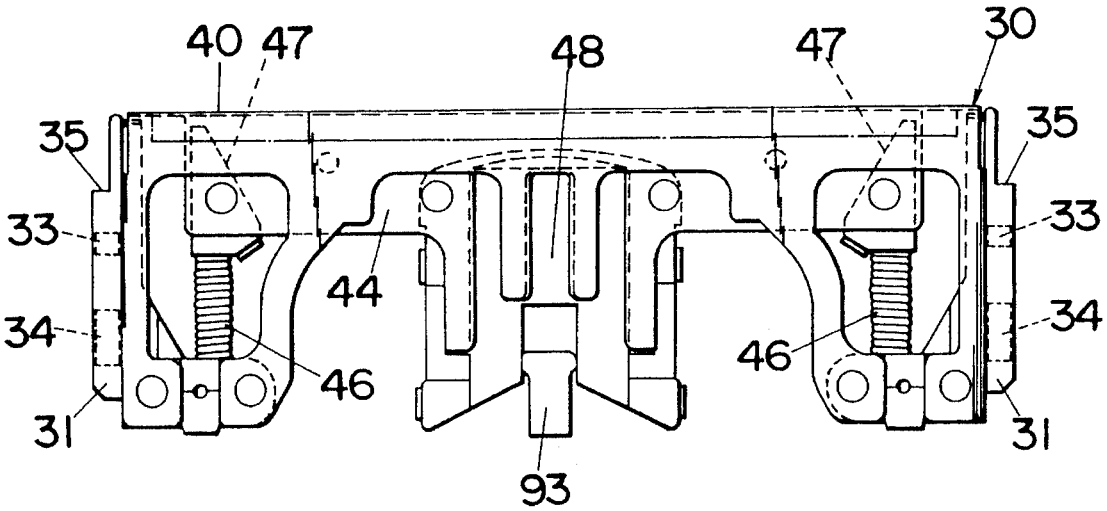
FIG. 7 is a front view of the center cutter head.

The center cutter head 30 is provided for rough shaving and comprises a slender stationary cutter 40 with a number of longitudinally spaced slits 41 and an elongated movable cutter 44 with a number of longitudinally spaced blades 45. The movable cutter 44 is driven by the joint assembly 90 to reciprocate in shearing engagement with the stationary cutter 40. As shown in FIG. 6, the stationary cutter 40 is shaped from a metal sheet into an inverted U-shape configuration with a top flat face and bulged edges 43 extending along the lateral sides of the top flat face. The slits 41 extends from the top flat face into the bulged edges 43 which act as a comb for smoothening the hairs into the slits 41. Thus formed stationary cutter 40 is secured at opposite longitudinal ends to holders 31 each having end face 32 exposed to the longitudinal end of the stationary cutter 40. The movable cutter 44 is assembled to the stationary cutter 40 to provide the center cutter head 30 as a unitary structure which is in turn assembled as a single structure to the head frame 5. The movable cutter 44 is held in slidable contact with the underside of the stationary cutter 40 with coil springs 46 interposed between the longitudinal ends of the movable cutter 44 and the corresponding holders 31. The coil spring 46 is coupled at its opposite ends to a fitting 47 secured to the longitudinal end of the movable cutter 44 and to the holder 31 so that it urges the movable cutter 44 against the stationary cutter 40 to give a suitable contacting pressure therebetween while retaining the movable cutter 44 to the stationary cutter 40. The coil springs 46 have enough flexibility to allow the reciprocating movement of the movable cutter 44. The stationary cutter 40 is formed at its center with a vertical guide groove 48 for engagement with corresponding guide 19 on the adjacent outer cutter head 10. Each holder 31 is formed in its end face 32 with a vertically spaced pair of first and second holes 33 and 34 which are utilized for mounting the center cutter head 30 to the head frame 5, as will be explained later. As shown in FIG. 6, the first hole 33 is smaller than the second hole 34.

The outer and center cutter heads 10 and 30 are floatingly supported to the head frame 5 respectively by outer and center spring members 14 and 54 which are molded as integral members in the associated holders 11 and 31. The outer spring members 14 are formed at the end plates 12 of the associated holder 11 and are each shaped into a generally E-shaped configuration with a vertically spaced pair of resilient beams 15 extending in substantially a parallel relation to each other and a coupler 16 which joins free ends of the beams 15. The coupler 16 includes a horizontal extension 17 extending between the beams 15 in a generally parallel relation thereto. The beams 15 are made thin enough so as to be resiliently deformable within the thickness of the end plate 12, whereby the horizontal extension 17 may be displaced together with the coupler 16 in a vertical plane. Each horizontal extension 17 is provided with a stud 18 extending outwardly for connection with the head frame 5. Thus, the outer cutter head 10 is supported at its longitudinal ends in a floating manner such that the one longitudinal end of the outer cutter head 10 is resiliently movable vertically substantially independently from the other longitudinal end. With this supporting structure, not only the two outer cutter heads 10 are allowed to move vertically independently from each other but also each cutter head 10 is allowed to move vertically in different vertical displacements at the two longitudinal ends so that each cutter head 10 can be inclined so as to best conform to the shape of the skin with a maximum skin engaging area. It should be noted in this connection that the resilient beam 55 extends through an angled segment from longitudinal end of one of the adjacent side plates 13 toward the longitudinal end of the other side plate 13 to extend over substantially the entire width or lateral dimension of the end plate 12 such that the outer spring member 14 is permitted to vertically displace over a maximum extent within a limited width of the end plate 12.

The center spring members 54 are provided on the side of the head frame 5 which comprises a rectangular chassis 50 of a plastic material having opposed end walls 52 integrally connected by opposed side walls 53. Each of the center spring member 54 is formed within the end wall 52 of the chassis 50 to have a generally E-shaped configuration with a pair of resilient beams 55 extending horizontally in parallel relation to each other, in the like manner as the outer spring member 14 formed in the holder 11 for the outer cutter head 10. The resilient beams 55 extend in parallel relation and terminate at their free ends into a coupler 56 with an upward extension 57. The beams 55 are made thin enough so as to be resiliently deformable within the thickness of the end wall 52, whereby the coupler 56 is allowed to displace in a vertical plane as flexing the beams 55. The coupler 56 is provided with a pair of vertically spaced first and second bosses 58 and 59 for engagement into the first and second holes 33 and 34, respectively at the longitudinal end of the holder 31 of the center cutter head 30. Thus, the center cutter head 30 is supported at its longitudinal ends in a floating manner such that the one longitudinal end of the center cutter head 30 is resiliently movable vertically substantially independently from the other longitudinal end, in the like manner as the outer cutter heads 10.

Figure 8:
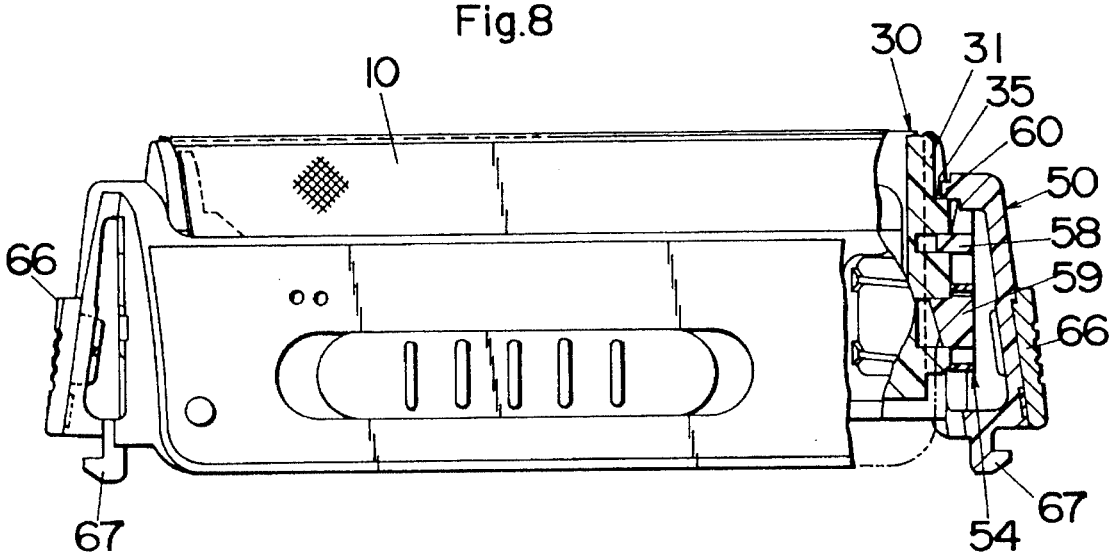
FIG. 8 is a front view, partly in section, of the shaver head.
Figure 9:
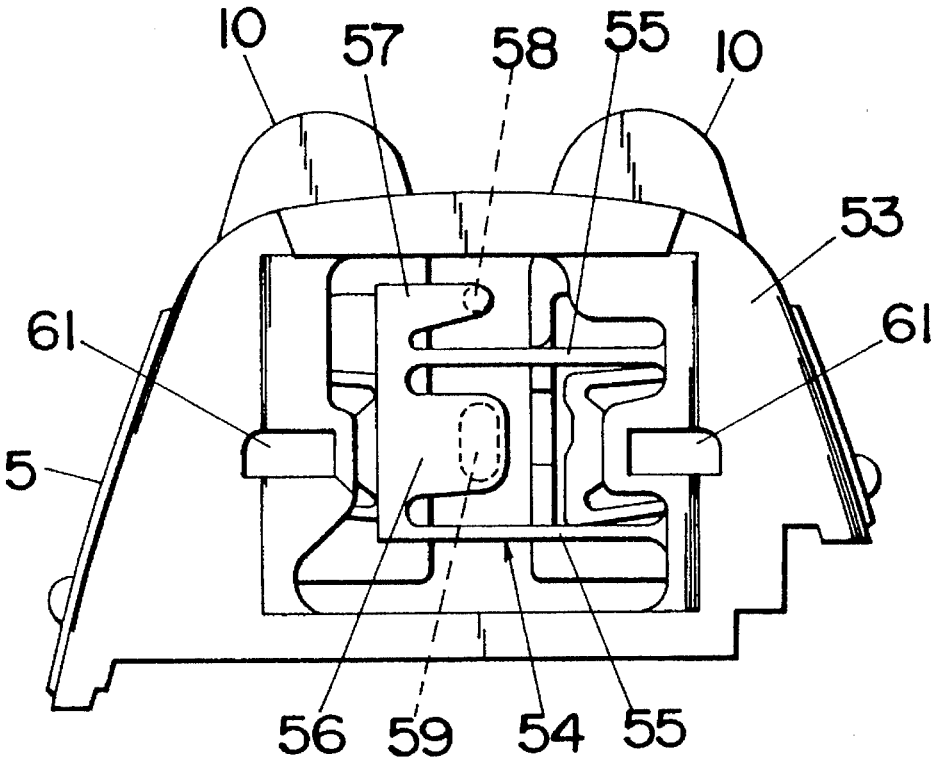
FIGS. 9 and 10 are side views illustrating the function of spring member for floatingly supporting the center cutter head.
Figure 10:
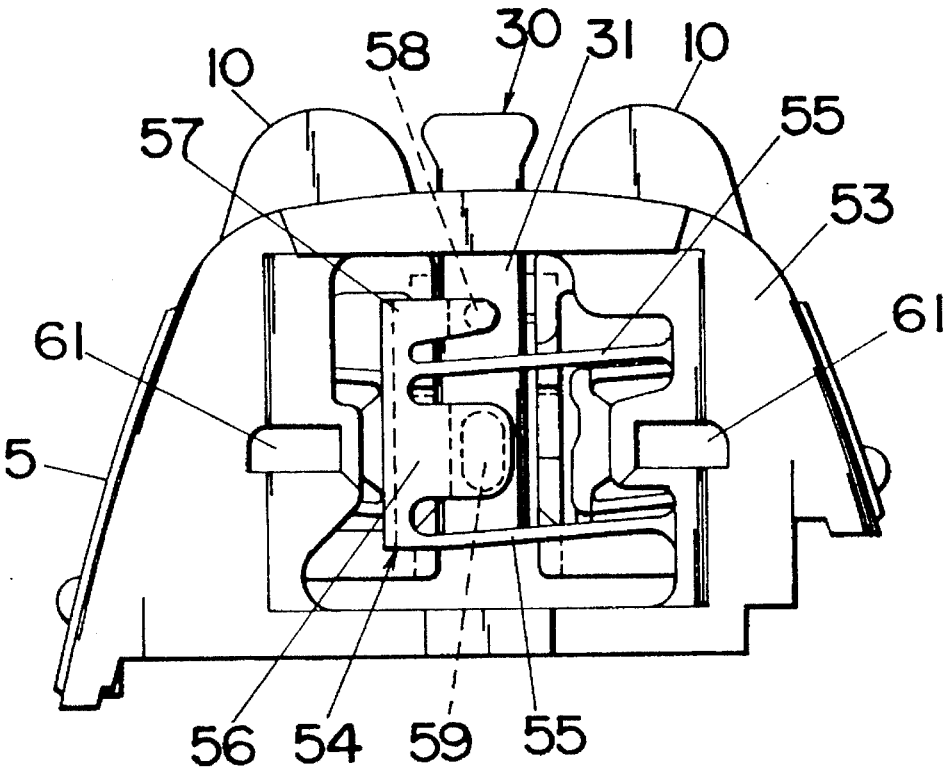

As shown in FIG. 9, the outer spring member 14 is formed within the end wall 52 as being offset toward one lateral end of the end wall 52 with the resilient beams 55 extending from one lateral end of the end wall 52 toward the other lateral end past a widthwise center thereof and but with the first and second bosses 58 and 59 positioned at the width center. With this offset arrangement of the outer spring member 54, the beams 55 can be made to have enough length to give sufficient vertical displacement of the center cutter head 30. In other words, since the outer spring members 14 are formed in the associated holders 11 and not in the head frame 5, the center spring members 54 can be formed in the end walls 52 of the head frame 5 without being interfered with or restricted by the outer spring members 14 so that the center spring members 54 can be configured to give a sufficient vertical amount of displacement to the center cutter head 30. As shown in FIG. 10, the center cutter head 30 is assembled to the head frame 5 by engagement of the bosses 58 and 59 of the spring members 54 into corresponding holes 33 and 34 with the resilient beams 55 caused to flex downwardly to some extent in order that the center spring members 54 bias the center cutter head 30 upwardly, at which condition, the center cutter head 30 is retained in this upwardly biased position by abutment of shoulders 35 at the respective end of the holders 31 against stops 60 projecting inwardly from the upper ends of the end walls 52 of the head frame 5, as shown in FIG. 8. Thus, the center cutter head 30 is constantly biased upwardly at its longitudinal ends so as to effectively prevent undesired see-saw oscillations of the center cutter head 30 when driving the movable cutter 44 to reciprocate in engagement with the stationary cutter 40. It is noted in this connection that the first and second bosses 58 and 59 are shaped into different sizes in correspondence to the first and second holes 33 and 34. That is, the first boss 58 is shaped into a rounded pin while the second boss 59 is shaped into an elongated stud with a minor dimension or width greater than the diameter of the first boss 58. The center cutter head 30 is assembled in position within the width center of the head frame 5 through a bottom opening thereof, during which the first hole 33 first encounters the second boss 59 and then the first boss 58. Since the first hole 33 is smaller than the second boss 59, the first hole 33 is not engaged with the second boss 59 during the assembly and is correctly engaged with the corresponding first boss 58, at this condition, the second hole 34 comes into registration with the second boss 59 for engagement therewith. Thus, the center cutter head 30 can be assembled in place correctly and easily.

The end walls 52 of the head frame 5 are each provided with a horizontally spaced pair of holes 61 which are engaged respectively with the studs 18 projecting on the holder 11 of the outer cutter heads 10 for floatingly mounting the outer cutter heads 10 on the opposite sides of the center cutter head 30. A guide groove 62 extends downwardly from each of the hole 61 to the bottom of the end wall 53 for guiding therethrough the corresponding stud 18 into engagement with the hole 61 in order to facilitate the assembly of the outer cutter head 10 to the head frame 5. The holder 11 is formed on its side plate 13 with a center post 24 which is engaged into corresponding vertical slot formed interiorly of the associated side walls 53 of the head frame 5 in order to prevent undesired longitudinal movement of the outer cutter heads 10 relative to the head frame 5 while allowing the vertical movement thereof. The like effect is made for the center cutter head 30 by engagement of the guide pin 19 on one of the outer cutter heads 10 and the guide groove 48 in the longitudinal center of the center cutter head 30.

As shown in FIG. 3, the center cutter head 30 is normally held at a position where the upper end of the center cutter head 30 is substantially in level with those of the adjacent outer cutter heads 10 so that these cutter heads of different shaving actions can be equally and selectively brought into contact with various portions of the skin for maximum shaving efficiency. Also, the bulged edges 43 of the center cutter head 30 are best utilized to absorb the space between the outer cutter heads 10 for shaving thereat in addition to smoothening the hairs into the slits 41 of the center cutter head 30. As shown in the figure, the center cutter head 30 is laterally spaced from one of the outer cutter heads 10 by a distance α which is greater than a distance β from the other cutter head 10 positioned laterally further away from the outer spring members 54 in the end walls 52 of the head frame 5. This is advantageous in that the one outer cutter head 10 disposed on the side of the outer spring members 54 is prevented from interfering with the downward movement of the center cutter head 30, which movement is inherently accompanied with more or less circular movement in relation to the supported ends of the resilient beams 55 of the outer spring members 54, i.e., the left-hand end of the head frame 5 as viewed in the figure.

Referring back to FIG. 5, the joint assembly 90 comprises a pair of joint tubes 91 each connected to the movable cutter 21 of each of the outer cutter heads 10 to drive the movable cutter 21 for reciprocation. One of the joint tubes 91 is formed with a center joint 93 which projects into engagement with a notch 49A (see FIG. 6) in a coupler 49 which extends downwardly from the lower center of the movable cutter 44 of the center cutter head 30 to drive the movable cutter 44 to reciprocate. Each of the joint tubes 91 includes a spring 92 (see FIG. 2) which biases the movable cutters 21 upwardly to give a suitable contacting pressure between the movable cutter 21 and the shearing foil 20 and to give an additional bias to the outer cutting head that each outer cutter head 10 can receive an upward bias not only from the outer spring members 14 but also from the spring 92 in the joint tube 91. While on the other hand, the center cutter head 30 is biased upwardly only by the center spring members 54 (see FIG. 3) such that the center cutter head 30 can be depressed easier or by a smaller external force than the outer cutter heads 10. The holder 11 of the outer cutter head 10 is provided with a guide pin 19 (see FIG. 3) which is engaged with the guide groove 48 in the center of the stationary cutter 40 of the center cutter head 30.

Figure 11:
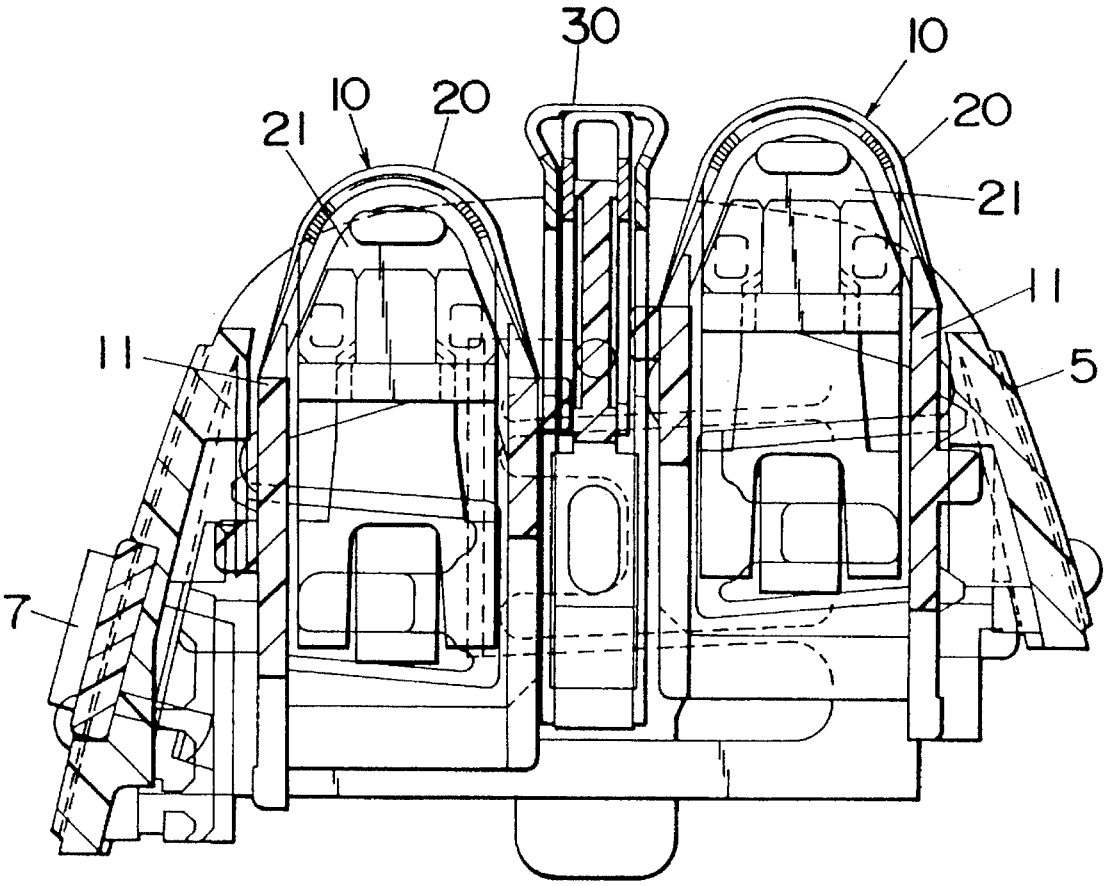
FIG. 11 is a side section of the shaver head with one outer cutter head shown in its lowered position.

The head frame 5 is provided on its side wall 53 of the chassis 50 with a slider handle 7 which is accessible by a finger of the user to move an associated slider 70 held on the interior of the side wall 53. The slider handle 7 has a pair of hooks 71 extending through openings 64 in the side wall 53 for engagement with corresponding notches 72 in the slider 70. One of the outer cutter heads 10 is formed on the side plate 13 of the holder 11 with a pair of longitudinally spaced follower pins 25 for connection with the slider 70. As shown in FIG. 11, the one outer cutter head 10 thus connected to the slider 70 can be held in a lowered position relative to the other outer cutter head 10 so as to disable the lowered outer cutter head 10 while enabling the other outer cutter head 10 and the center cutter head 30 for successfully shaving the restricted area selectively by one of the outer cutter heads 10 and the center cutter head 30. To this end, the slider 70 has a pair of longitudinally spaced windows 73 having inclined can edges 74 between two horizontal edges of different vertical levels. The holder 11 of the associated cutter head 10 is coupled to the slider 70 with the follower pins 25 projecting into the windows 73, respectively, in slidable contact with a portion including the cam edges 74 and the horizontal edges, such that the cutter head 20 is lowered and raised in response to that the follower pins 25 moves from the one horizontal edge to the other horizontal edge through the cam edge 74 within each window 73 as a result of moving the slider 70 along the length of the side wall 53. In this manner, the sliding movement of the slider 70 is converted to displace the cutter head 10 vertically and the cutter head 20 can be held either at the lower or raised position where each of the follower pins 25 engages the corresponding one of the two horizontal edges. At the raised position, the cutter head 10 is allowed to displace downwardly against the bias of the outer spring members 14. The slider 70 is provided with a latch which retains the associated cutter head 10 in its lowered position. The latch is released by forcibly moving the slider 70 and therefore the slider handle 7 in one direction.

The head frame 5 is detachably mounted to the support frame 3 with knobs 66 on the end walls 53 received within corresponding slots in the support frame 3. The knob 66 includes a hook 67 which is latched into a corresponding detent in the head frame 3, as shown in FIG. 4. Although the head frame 5 is shown to be detachably supported to the support frame 3 in the above embodiment, the present invention is not limited thereto and may be so constructed to eliminate the support frame and to mount the head frame 5 directly on the shaver housing instead.

The motor 80 is energized and deenergized by an operation of a switch handle 84 slidably mounted on the front face of the housing 1. The shaver is additionally formed with a trimmer 9 on the rear face of the housing 1.

Figure 12:
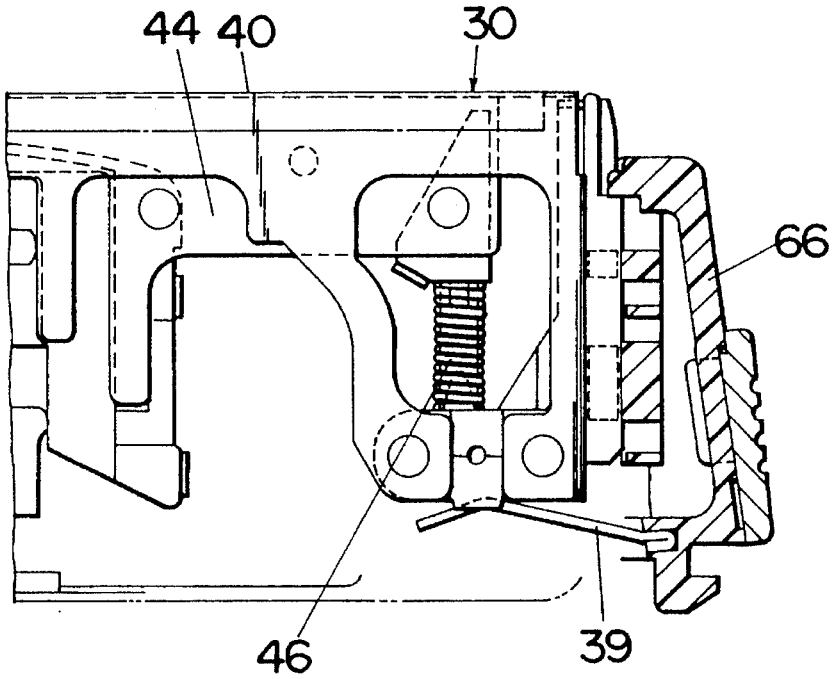
FIG. 12 is a partial view of a modified center cutter head.

FIG. 12 shows a modification of the above embodiment in which a spring 39 is included to give an additional upward bias to the center cutter head 30 so that the center cutter head 30 is depressed against the bias of the center spring members 54 plus the spring 39.

Second embodiment <FIGS. 13 to 16>

Referring to FIGS. 13 to 16, there is shown a reciprocatory shaver in accordance with a second embodiment of the present invention which is basically identical in structure and operation to the first embodiment except that a differently configured center cutter head 30A is utilized in combination with the outer cutter head 10A of the like configurations. For the purpose of simplicity and avoiding duplicate description, like parts are designated by like numerals with a suffix letter of "A". The center cutter head 30A is provided for rough shaving and comprises an elongated holder 31A mounting a stationary cutter plate 40A with a toothed edge and a movable cutter plate 44A with a like toothed edge driven by a like joint assembly 90A to reciprocate in sliding contact with the toothed edge of the stationary cutter plate 40A. Also included in the center cutter head 30A is a comb plate 36 which is formed with a toothed upper edge and is secured between end faces 32A of the holder 31A to carry a spring 46A for pressing the movable cutter plate 44A against the stationary cutter plate 40A at a suitable contact pressure. The toothed edges of the comb plate 36 and the stationary cutter plate 40A are bent horizontally in opposite directions for smoothening the hairs to be cut between the stationary and movable cutter plates 40A and 44A.

The outer and center cutter head 10A and 30A are floatingly supported to a like head frame 5A by means of like outer and center spring members 14A and 54A which are formed in end plates of like holders 11A of the outer cutter heads 10A and end walls 52A of the head frame 5A. The outer cutter head lea is assembled to the head frame 5A by engagement of laterally spaced studs lea on the outer spring member 14A of the holder 11A into corresponding holes 61A in the end walls 52A of the head frame 5A. While, on the other hand, the center cutter head 30A is assembled by engagement of vertically spaced bosses 58A and 59A into corresponding holes 33A and 34A in the end faces of the holder 31A. The center cutter head 30A thus assembled to the head frame 5A is kept at a raised position of FIG. 13 while flexing resilient beams 15A of the center spring members 14A downwardly such that the center cutter head 30A is constantly urged upwardly thereby in the like manner as in the first embodiment. The outer cutter heads 10A include movable cutter 20A which are of like configuration as in the first embodiment and are coupled to joint tubes 91A of the joint assembly 90A, respectively to be driven thereby to reciprocate. The joint tubes 91A is provided with springs 92A for give an upward bias to the movable cutter 20A and therefore to the outer cutter head 10A in addition to that of the outer spring members 14A. One of the joint tubes 91A is formed with a center joint 93A which is coupled to the movable cutter plate 44A of the center cutter head 30A to reciprocate.

Figure 13:
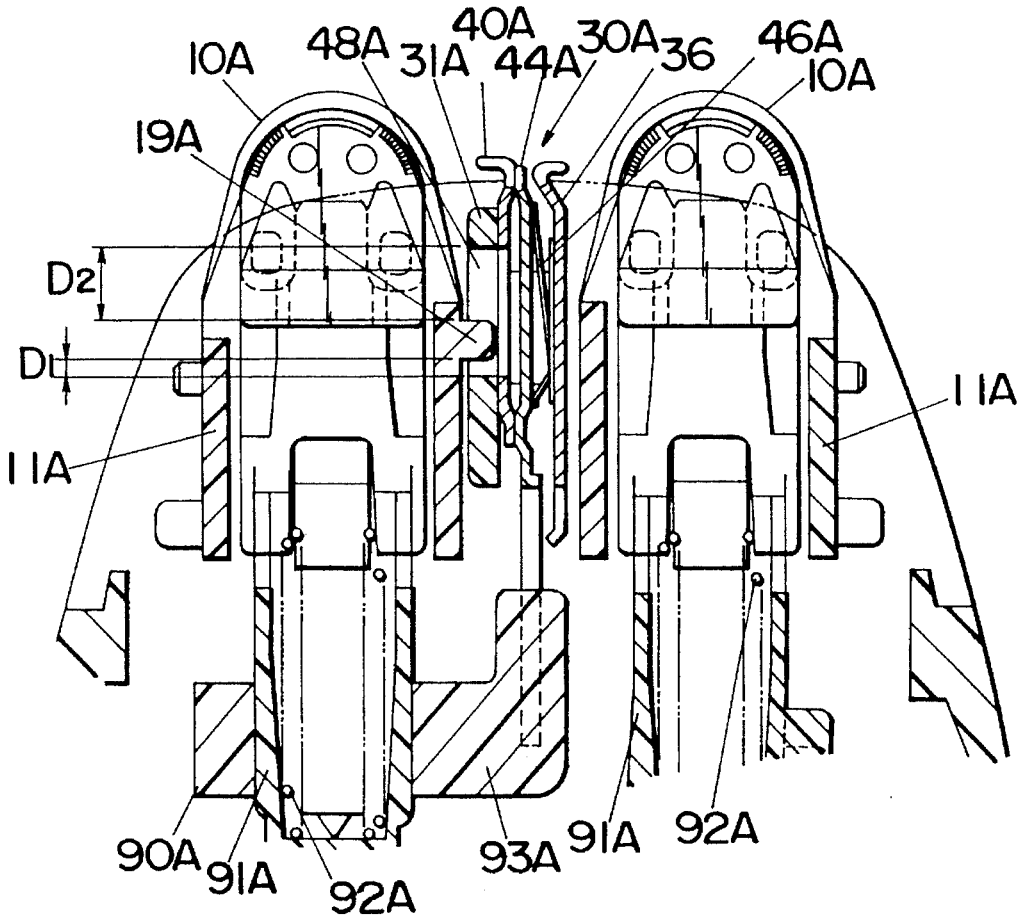
FIG. 13 is a vertical side section of a shaver head in accordance with a second embodiment of the present invention.
Figure 14:
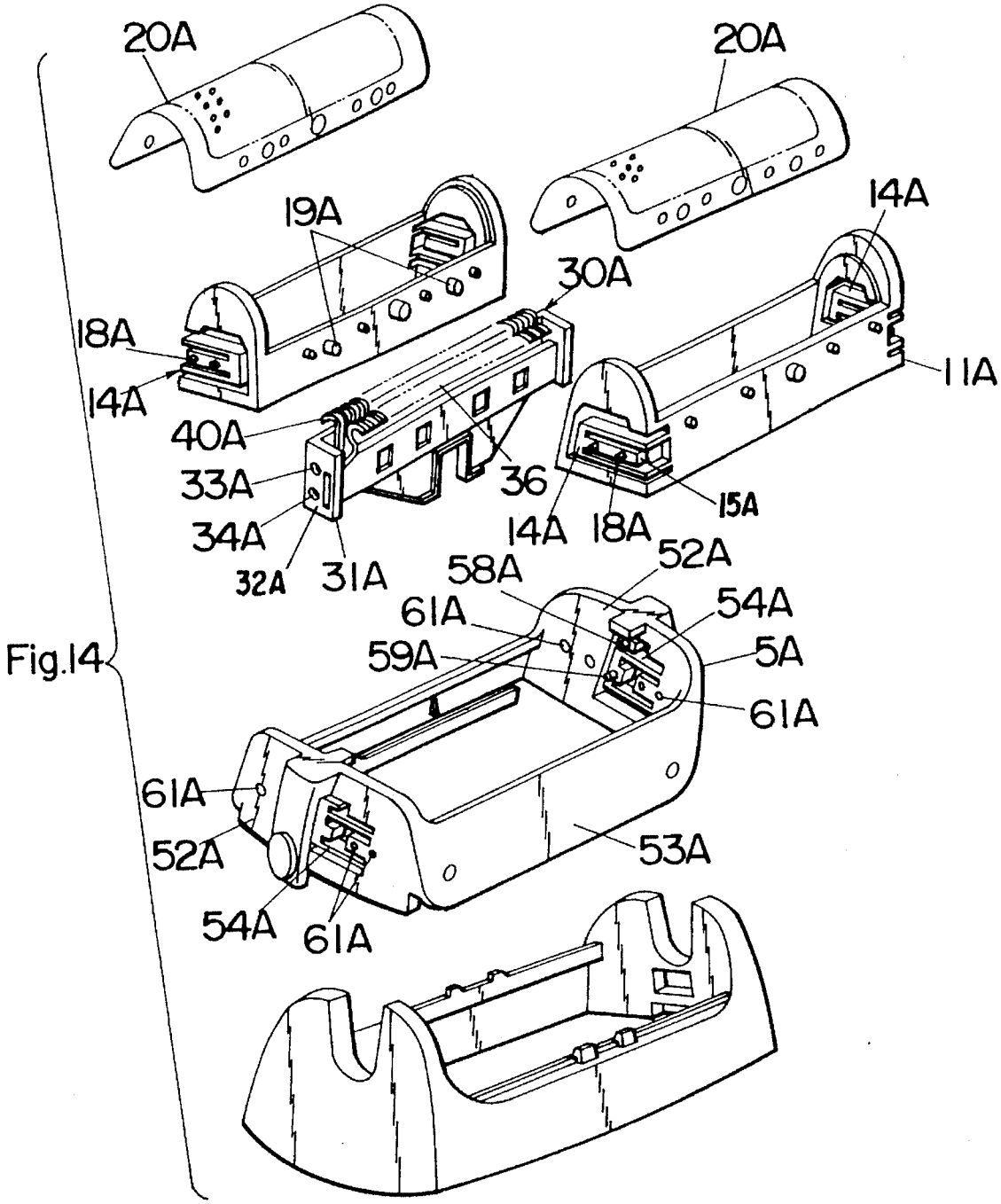
FIG. 14 is an exploded perspective view of the shaver head of FIG. 13.
Figure 15:
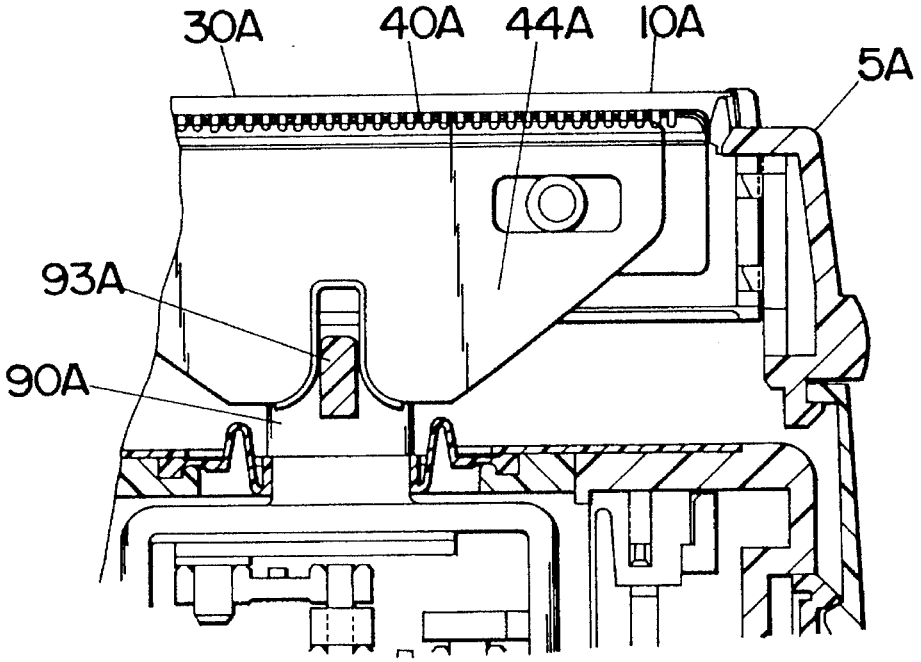
FIG. 15 is a partial front section of the shaver head of FIG. 13.
Figure 16:
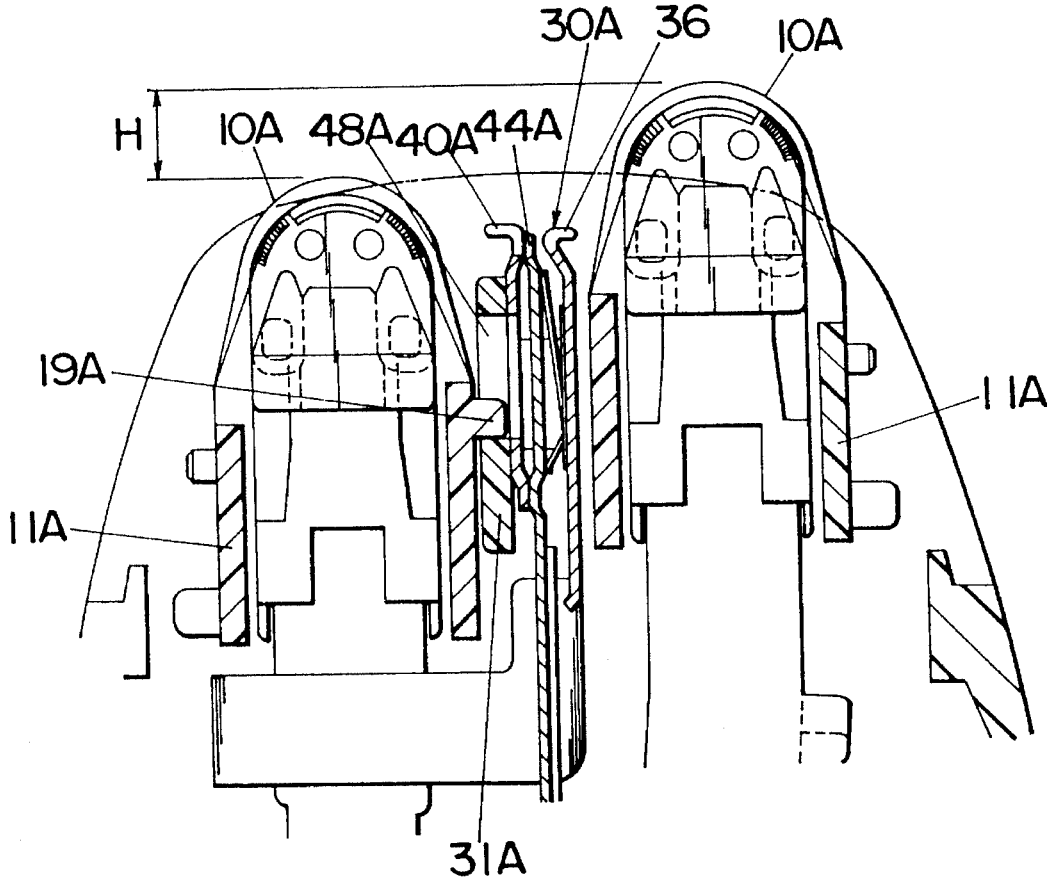
FIG. 16 is a side section of the shaver head with a center cutter head lowered together with an adjacent outer cutter head.

As shown in FIGS. 13 and 14, one of the outer cutter head 10A is provided on the associated holder 11A with a pair of longitudinally spaced guide pins 19A which engage into vertically extending guide grooves 48A correspondingly formed in the holder 31A of the center cutter head 30A, thereby permitting the center cutter head 30A to displace vertically while preventing undesired longitudinal movement thereof. The engagement of the guide pin 19A into the guide groove 48A is such that when the center cutter head 30A in the raised position, the guide pin 19A is spaced upwardly from the bottom of the guide groove 48A by a short distance of $D_1$ and spaced downwardly from the top of the guide groove 48A by a long distance of $D_2$ within which the center cutter head 30A is allowed to move downwardly independently of the adjacent outer cutter head 10A. As shown in FIG. 16, the outer cutter head 10A thus associated with the center cutter head 30A is allowed to move downwardly relative to the other outer cutter head 10A by a maximum distance of H which is greater than the distance $D_2$. Therefore, the outer cutter head 10A can be depressed independently of the center cutter head 30A initially by the distance of $H-D_2$ until the pin 19A abuts the bottom of the guide groove 48A, after which the outer cutter head 10A is interlocked with the center cutter head 30A so that the outer cutter head 10A is depressed further downwardly together with the center cutter head 30A.

What is claimed is:

1. A reciprocatory dry shaver comprising:

a shaver housing having a head frame which carries three elongated cutter heads each having a longitudinal axis, said three elongated cutter heads composed of a center cutter head and two outer cutter heads arranged on opposite sides of said center cutter head with the individual longitudinal axes substantially parallel to each other, each of said two outer cutter heads comprising an outer foil and an outer movable cutter driven to reciprocate along said longitudinal axis of each of said two outer cutter heads in hair shearing engagement with said outer foil of each of said two outer cutter heads, said center cutter head comprising a stationary cutter and a center movable cutter driven to reciprocate along said longitudinal axis of said center cutter head in hair shearing engagement with said stationary cutter of said center cutter head;

wherein said center and outer cutter heads are floatingly supported to said head frame respectively by associated center and outer spring members so that each of said three elongated cutter heads is vertically movable relative to said head frame, and wherein said center spring member gives a bias for floatingly supporting said center cutter head which is less than a bias for floatingly supporting said outer cutter heads.

2. A reciprocatory dry shaver as set forth in claim 1, wherein said stationary cutter of said center cutter head is of a generally U-shaped configuration with a top wall and a pair of side walls depending from opposed lateral sides of said top wall, said top wall being formed with a plurality of slits which are spaced along the longitudinal axis of said center cutter head and are opened into said opposed side walls.

3. A reciprocatory dry shaver as set forth in claim 1, wherein said outer foil of each of said two outer cutter heads and said stationary cutter of said center cutter head are held respectively by holders, and wherein at least one of said center cutter head and outer cutter heads is coupled at its longitudinal ends to said head frame through fastener means, said fastener means comprising a pair of vertically spaced first and second bosses projecting from one of the associated holder and the head frame into intimate engagement with a pair of first and second holes correspondingly formed in the other of said associated holder and said head frame, said second boss being greater in diameter or cross-sectional area than said first boss to disable the engagement of said second boss into the first hole.

4. A reciprocatory dry shaver as set forth in claim 1, wherein said center cutter head has its upper end disposed at substantially the same height as corresponding upper ends of said outer cutter heads.

5. A reciprocatory dry shaver as set forth in claim 1, wherein said center spring member for said center cutter head comprises a plurality of vertically spaced resilient beams having free ends and extending from said head frame in substantially a parallel relation to each other and a coupler which joins the free ends of said resilient beams so that said center spring member is vertically movable relative to said head frame by resiliently deforming said resilient beams, said coupler being connected to said center cutter head, said center cutter head being disposed closer to one of said outer cutter heads than to the other outer cutter head.

6. A reciprocatory dry shaver as set forth in claim 1, wherein said center cutter head includes a holder to which said stationary cutter is fixed, said holder carrying a spring which is connected to urge said center movable cutter against said stationary cutter such that said center cutter head is assembled into a unitary block including said stationary cutter, said center movable cutter, said holder, and said spring, said center cutter head being biased upwardly by said center spring member until a stopper formed on said center cutter head abuts against a portion of said head frame.

7. A reciprocatory dry shaver as set forth in claim 1, further including lock means for restraining said center cutter head and one of said outer cutter heads together to a depressed position.

8. A reciprocatory dry shaver as set forth in claim 1, wherein said each of said two outer cutter heads includes a rectangular holder to which said outer shearing foil of said each of said two outer cutter heads is fixed, said holder being formed in a lengthwise side with a recess.

9. A reciprocatory dry shaver as set forth in claim 1, wherein said each of said two outer cutter heads is capable of being depressed against a bias of said center spring member plus a bias of said outer spring members and said center cutter head is capable of being depressed substantially only against a bias of said center spring member.

* * * * *